United States Patent [19]

Hickman

[11] 4,127,260

[45] Nov. 28, 1978

[54] WORKBENCH WITH QUICK SETTING VISE STRUCTURE

[75] Inventor: Ronald P. Hickman, Waltham Abbey, England

[73] Assignee: Inventec International Limited, Sark, Channel Islands

[21] Appl. No.: 673,066

[22] Filed: Apr. 2, 1976

[51] Int. Cl.[2] ..... B25B 1/22

[52] U.S. Cl. ..... 269/139; 269/212; 269/220; 269/244; 269/321 CF

[58] Field of Search ..... 108/121, 123, 115; 182/153, 155, 224; 144/285, 286 R, 286 A, 287, 288 R, 288 C; 269/219, 220, 221, 222, 240, 244, 258, 164, 165, 214, 139

[56] References Cited

U.S. PATENT DOCUMENTS

| | | | |
|---|---|---|---|
| 968,038 | 8/1910 | Everest | 269/220 |
| 985,857 | 3/1911 | Thomas | 269/222 |
| 1,039,337 | 9/1912 | Vanderbeek | 269/214 |
| 1,626,624 | 5/1927 | Morrison et al. | 108/121 |
| 3,001,559 | 9/1961 | Szopa | 144/286 R |
| 3,615,087 | 10/1971 | Hickman | 269/244 |
| 3,817,349 | 6/1974 | Barthel | 182/155 |

FOREIGN PATENT DOCUMENTS

| | | | |
|---|---|---|---|
| 14,565 of | 1892 | United Kingdom | 269/212 |

*Primary Examiner*—Robert C. Watson

*Attorney, Agent, or Firm*—Brumbaugh, Graves, Donohue & Raymond

[57] ABSTRACT

A portable workbench having a top surface including two vise members, one of which is connected to the supporting structure by a pair of releasable gripping devices which enables the vise member to move, in the plane of the support provided by the underlying support framework, toward the other vise member in a rectilinear motion and also in a rotational motion relative to the second vise member. One or the other of the vise members is also connected to the supporting framework by a pair of vise-operating devices which can be operated to exert a force for moving the vise member a small incremental distance toward the first vise member under force to effect the clamping action. A folding leg structure is provided to support the top surface at convenient working height above the floor.

22 Claims, 14 Drawing Figures

FIG. 3
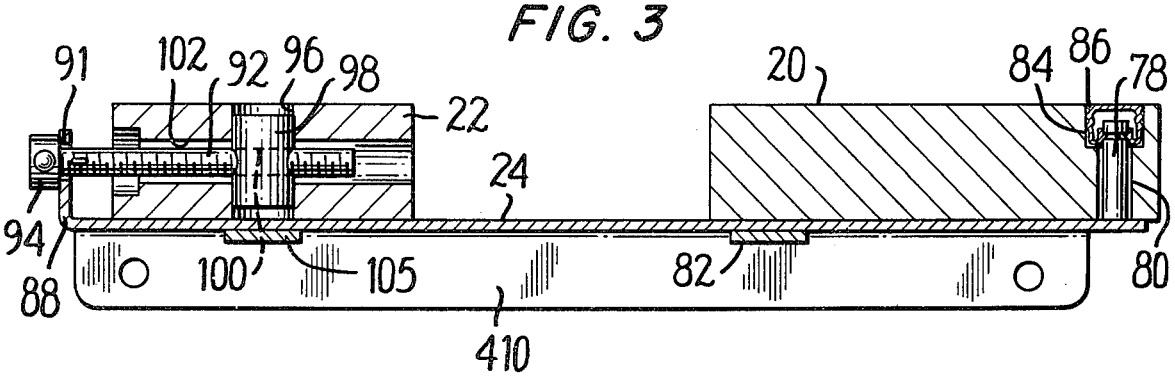
FIG. 4
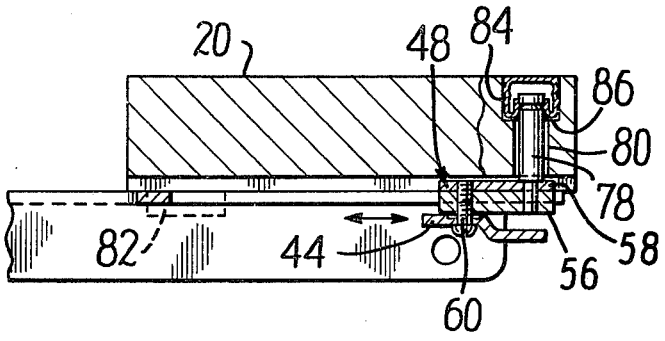
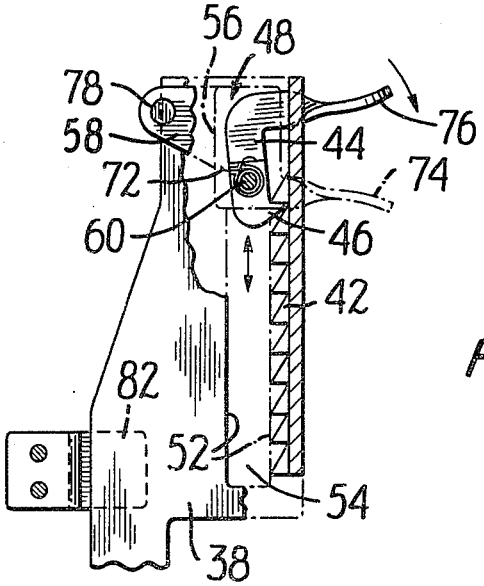
FIG. 5

WORKBENCH WITH QUICK SETTING VISE STRUCTURE

BACKGROUND OF THE INVENTION

This invention relates to workbenches, and in particular it relates to a portable workbench incorporating a giant vise.

A portable workbench of my invention, disclosed and claimed in U.S. Pat. No. 3,615,087 and an improved portable workbench as disclosed in my pending application Ser. No. 642,742 filed on Dec. 22, 1975 have been in use for some time with growing public acceptance and appreciation of their usefulness. Although the market is extremely satisfied with the utility and convenience of the portable workbenches, I have concluded that it would be desirable to decrease the cost of manufacture and to add certain features of convenience which, taken together, would militate for even greater public acceptance of and satisfaction with these portable workbenches.

In particular, I believe some potential and actual users of these portable workbenches would find it useful to have a means for rapidly closing the gap between the vise members. For example, when the gap between the vise members is at its largest and it is desired to clamp a small or a thin workpiece between the vise members, it is now necessary to wind the screw handles until the movable vise member is near the stationary vice member. Although this operation can be accomplished in a matter of a few seconds, I believe some users would prefer to have the capability of sliding the movable vise member in one quick motion toward the other vise member and thereby eliminate the need for a long hand cranking operation on the vise-operating screw rods.

By providing the capability of angular movement of the quick setting vise member, I find that the other vise member need not be provided with significant angleable capability. The only angleable capability necessary for the other movable vise member would be that needed for the convenience of independently operating each vise operating device independently to move each end the small incremental distance necessary to effect a sufficient clamping force on the workpiece without causing the clamping devices to bind up.

SUMMARY OF THE INVENTION

Accordingly, it is an object of this invention to provide a portable workbench incorporating a giant vise as a portion or the entirety of its working surface, and in which one vise member is connected to the support structure in a manner which enables the vise member to be moved rapidly and in a single motion toward the other vise member to position the two vise members against the opposite faces of the workpiece, and to provide a clamping arrangement for moving the vise members relatively together an incremental distance to forcefully clamp the workpiece between the two vise members.

This object is achieved by providing a portable workbench having a top surface including two vise members, one of which is connected to the supporting structure by a pair of releasable gripping devices which enables the vise member to move, in the plane of the support provided by the underlying support framework, toward the other vise member in a rectilinear motion and also in a rotational motion relative to the second vise member. One or the other of the vise members is also connected to the supporting framework by a pair of vise-operating devices which can be operated to exert a force for moving the vise members a small incremental distance toward each other under force to effect the clamping action. A folding leg structure is provided to support the top surface at a convenient height above the floor.

DESCRIPTION OF THE DRAWINGS

A more complete appreciation of the invention and its many attendant advantages will become more apparent upon reading the following detailed description in connection with an examination of the appended drawings, wherein:

FIG. 3 is a sectional view along lines 3—3 in FIG. 1;

FIG. 4 is a sectional view along lines 4—4 in FIG. 1;

FIG. 5 is a sectional view along lines 5—5 in FIG. 2;

DESCRIPTION OF THE PREFERRED EMBODIMENTS

Figures 1, 2:
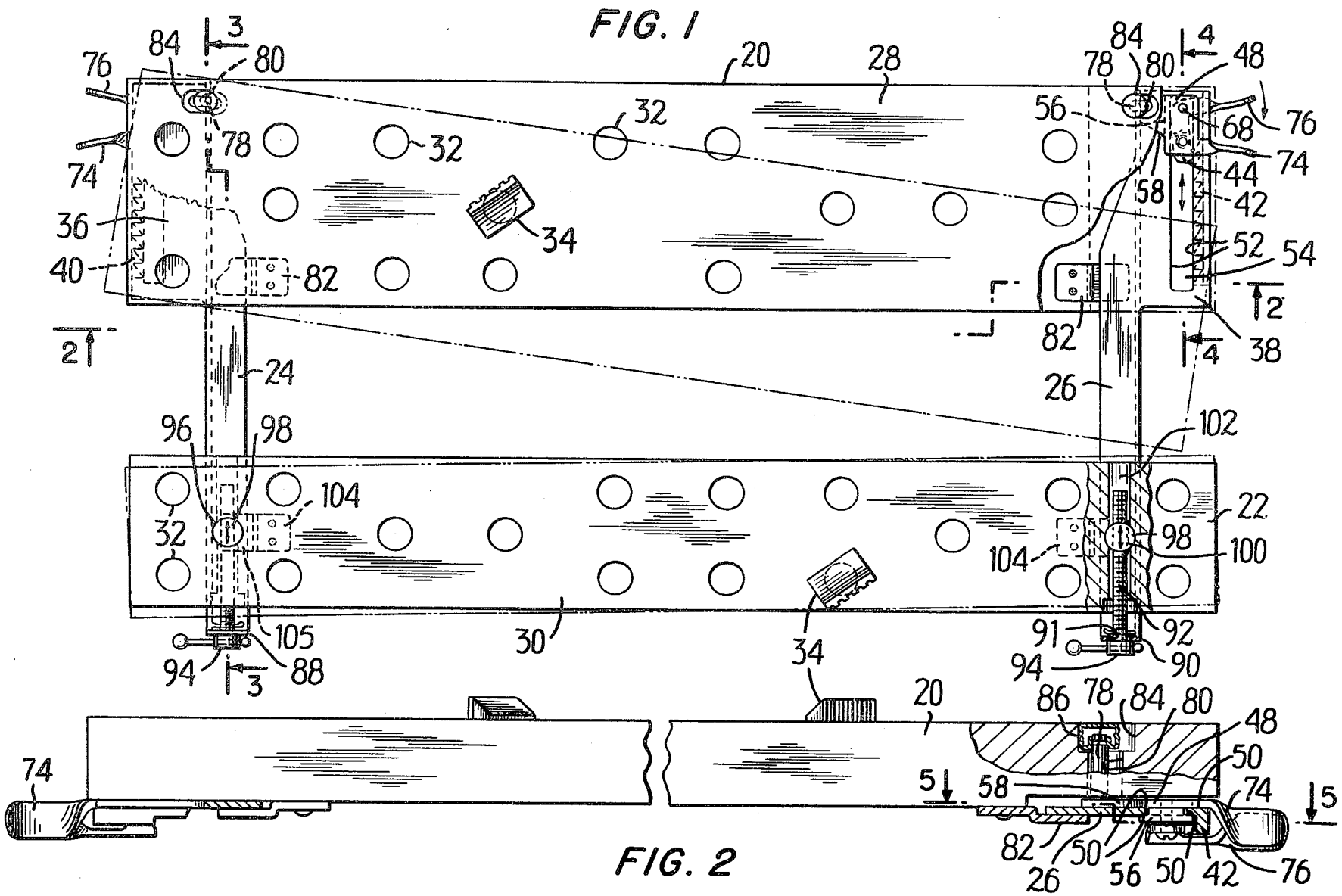
FIG. 1 is a plan view of the top structure of one embodiment of a workbench constructed according to this invention.
FIG. 2 is a sectional view along lines 2—2 in FIG. 1.

Referring now to the drawings wherein like reference characters designate corresponding or identical elements, and more particular to FIG. 1 thereof, a pair of elongate vise members 20 and 22 is shown supported on a pair of horizontally spaced support members 24 and 26. The elongate vise members 20 and 22 have upper surfaces 28 and 30 respectively which lie in a horizontal plane and form the complete upper working surface of the workbench. When the vise members 20 and 22 are brought together, in a manner which will be described below, to completely close the gap between them, the upper surfaces 28 and 30 form a planar working surface which is continuous except for a plurality of circular openings formed by a plurality of circular bores 32 extending completely through the vise members for slidably and rotatably receiving abutment members 34. The abutment members 34 are alike and for the same purpose as the abutment members shown in FIG. 6 of my co-pending U.S. application Ser. No. 642,742 filed on Dec. 22, 1975, the disclosure of which is incorporated herein by reference.

The vise member 20, which hereafter will be referred to as the rear vise member for ease of reference, is supported by the rear portions of the spaced support members 24 and 26. The rear portions of support members 24 and 26 have portions 36 and 38 which project outwardly or outboard of the portions of support members 24 and 26 which extend across the gap between the vise members 20 and 22. Each of the outboard extremities of offset portions 36 and 38 has formed thereon a ratchet 40 and 42, respectively. The teeth of the ratchets 40 and 42 face inwardly or inboard in a direction toward each other.

Figure 5A:
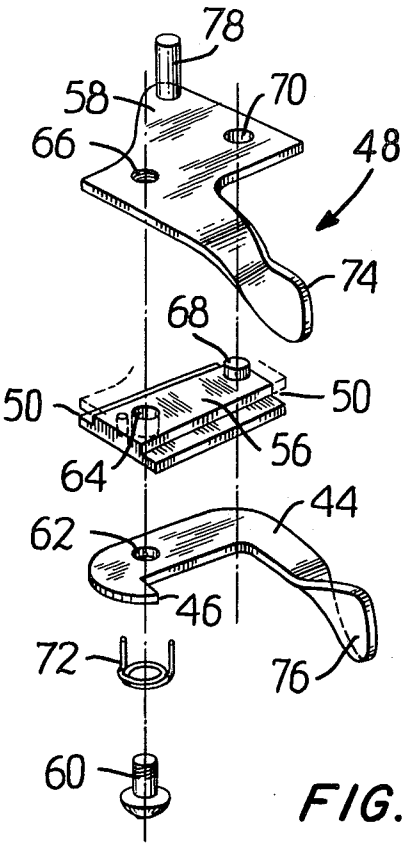
FIG. 5A is an exploded perspective view of the ratchet pawl and sliding block shown in FIGS. 1, 2 and 5.

As shown most clearly in FIG. 5a, a pawl 44, including a tooth portion 46, is pivotally mounted on a sliding block 48 and is spring biased by a spring 72 to engage the teeth of the ratchet 42. The block 48 has a pair of laterally opening grooves 50 extending in the direction of the support members 24 and 26. The grooves 50 receive the lateral edges 52 of a slot 54 formed in the offset portions 36 and 38 of the support members 24 and 26. The slot 54 runs in the direction of the support members and is physically located adjacent and inboard of the ratchets 40 and 42.

The laterally facing vertical faces of the grooves 50 engage the corresponding laterally facing vertical faces of the slot 54 to restrain the block 48 from moving in a lateral direction, that is, in the direction of elongation of the vise member 20, which would tend to carry the pawl 44 away from and out of engagement with the ratchet 42. The upwardly and downwardly facing surfaces of the grooves 50 and the corresponding upwardly and downwardly facing surfaces of the edges 52 of the slot 54 are in engagement to prevent the block 48 from moving vertically upwardly or downwardly and also from twisting out of the plane of movement defined by the support members 24 and 26 so that the block 48 is restrained to pure rectilinear motion fore and aft in the slot 54.

As shown most clearly in FIG. 5A, the grooves 50 are formed by a rabbitted plate 56 to which is connected a top plate 58 by a threaded connector 60 which extends through a hole 62 in the pawl 44, through a hole 64 in the plate 56 and is then threaded into a tapped hole 66 in the top plate 58. A pin 68 fixed in the plate 56 extends through an aligned hole 70 in the top plate 58 to prevent the top plate 58 from rotating relative to the plate 56. The pawl 44 is rotatably mounted on the connector 60 and is biased toward engaging rotation i.e. counterclockwise rotation as seen in FIG. 5 by a spring 72 acting on the pawl 44. A static thumb bar 74 is disposed opposite the thumb bar 76 of the pawl 44 to provide a reaction member for ease in operating the pawl 44 by merely squeezing the bars 74 and 76 together to rotate the pawl.

A vertically extending pin 78 is fixed in the top plate 58 and extends into an elongated slot 80 formed in the vise member 20. The slot 80 extends vertically completely through the vise member 20. The slot 80 provides lateral clearance for the vise member 20 to rotate through a horizontal angle in the plane of support provided by the support members 24 and 26. Thus, as one end of the vise member 20, shown in phantom lines in FIG. 1 is moved toward the vise member 22 while the other end of the vise member 20 is not moved, the foreshortening of the bar 20 will cause the slot 80 to translate inward with respect to the pin 78 which in turn is constrained laterally by virtue of the lateral edges 52 of the slot 54 acting in the inboard groove 50 of the block 48.

The vise member 20 is restrained from upward movement at the front side of the vise member on both ends by a pair of brackets 82. The brackets 82 are connected to the underside of the vise member 20 adjacent and inboard of the horizontal supports 24 and 26.

The upper end of the slot 80 is countersunk at 84 and a fastener 86; having a horizontal dimension such that it will not pass downwardly through the slot 80, is fastened to the top of the pin 78 to provide vertical restraint for the vise member 20 at the rear edge thereof at both lateral ends of the vise member 20. A plug covers the countersunk slot 84 to make the work surface continuous at that point.

Thus, the vise member 20 is able to move freely in a rectilinear direction toward the vise member 22 by merely pulling the vise member 20 in that direction. When this occurs the pawl 44 will ride over the teeth 42 and the vise member will slide smoothly along the horizontal supports 24 and 26 toward the vise member 22. When it is desired to move either end of the vise member 20 toward the corresponding end of the vise member 22, that may be done by simply pulling on the desired end of the vise member 20 whereupon the pawl 44 will override the teeth 42 as the slot 80 translates in an inboard direction with respect to the pin 78. Whether the vise member is moving in a purely rectilinear motion as described, or in any combination of rectilinear or rotational movement, the vise member 20 is restrained from upward movement of any rotational movement that would tend to carry the vise member 20 away from the horizontal supports 24 and 26. The fastener 86, acting on the upwardly facing surface of the countersunk slot 84 restrains the rear edge of the vise member from lifting away from the block 48, and the upwardly facing surfaces of the grooves 50 acting against the downwardly facing surfaces of the edges 52 of the slot 54 formed in the outwardly offset portions 36 and 38 restrain the block 48 from upward movement relative to the supports 24 and 26. Thus the vise member 20 is freely movable on the plane of support defined by the support members 24 and 26 but is firmly restrained from any motion out of that plane.

The offset portions 36 and 38 make it possible to leave the gap between the vise members 20 and 22 clear so that a workpiece of considerable vertical dimension may be placed between the vise members 20 and 22 at either end thereof. When the rear vise member is then moved into engagement with the workpiece so that the clamping face of the vise member is parallel to the face of the workpiece, the engagement of the pawl 44 with the ratchet 42 prevents both ends of the vise member 20 from moving away from the vise member 22. By positioning the ratchet 42 at the outboard extremity of the workbench, it is possible to position the workpiece between the vise members at either extreme end thereof while maintaining positive control of the angular orientation of the clamping faces of the vise members. For example, if the ratchet 42 and pawl 44 were set inboard of the ends of the vise member 20, for example, in line with the portion of the horizontal supports 24 and 26 which extend between the vise members, and if workpiece were clamped between the outboard extremities of the vise members, outboard of the ratchet and pawl on that side, a clamping force on the workpiece would tend to cause the vise jaws to act as a lever fulcrumed at the ratchet near that end, so the other end would tend to move together. Since the ratchet and pawl are designed to resist a strong force only in the direction away from the vise member 22, the spring on the pawl might be overcome under a strong clamping force to carry the vise member 20 at the end opposite the end at which the workpiece is being clamped toward the vise member 22. This would upset the desired angular orientation of the vise member 20 with respect to the vise member 22 which had been set. By positioning the ratchet and pawl 42 and 44 at the outboard extremities, this condition is avoided.

Looking again at FIG. 1, the front vise member 22 rests on the support members 24 and 26 near the front ends thereof. The front ends of the support members 24 and 26 are provided with vertically extending portions 88 and 90 respectively. In each portion 88 and 90 a hole 91 is formed for receiving a horizontally extending screw 92. A screw handle 94 is attached to the front end portion of the screw 92 which extends forwardly through the hole 91. A pin is driven through a hole formed laterally in the screw 92 immediately behind the portion 88 and 90 to prevent the screw 92 from moving axially with respect to the front members 88 and 90.

The front vise member 22 has formed in the underside thereof a cylindrical bore 96 in which is positioned a barrel nut 98 having the same diameter as the bore 96. A threaded hole 100 extends laterally through the barrel nut and threadedly receives the screw 92. A horizontally extending hole 102 is drilled into the front face of the vise member 22 intersecting the vertical bore 96. The hole 102 is of a larger diameter than the screw 92 to accommodate a limited degree of angular movement of the front vise member 22.

A bracket 104 is screwed to the underside of the vise member 22 adjacent each horizontal support member 24 and 26 and has an offset portion 105 which extends under the support members. The brackets 104 prevent the vise member 22 from lifting vertically away from the horizontal supports 24 and 26 and also prevent the vise member 22 from any rotational movement which would tend to carry any portion of the vise member 22 away from the plane of support of the supports 24 and 26. However, the brackets do permit horizontal movement of the vise member 22 in the plane of support.

In use, when it is desired to clamp a workpiece between the vise members 20 and 22, the workpiece is laid in the gap between the vise members upon the horizontal supports 24 and 26. The vise member 20 is then moved manually toward vise member 22 by simply pulling the vise member 20 manually toward the other vise member which will cause the ratchet pawl 44 to slide over the teeth of the ratchet 42 until the proper position of the front vise member has been achieved. It is thus possible to set the gap between the vise members to approximately the desired size and shape of the workpiece in one quick motion.

To produce the desired clamping force, the screw handles 94 of the two vise operating screw threaded rods 92 are operated to move the front vise member against the workpiece. Since the distance which the front vise member must move to produce a strong clamping force is very short, by reason of the quick setting of the rear vise member, the screw threads of the screw threaded rods 92 may be very fine, that is, a large number of threads per inch. This enables an extremely strong clamping force to be exerted with great ease by the screw handles 94 and also makes it possible to use a smaller diameter screw rod. In addition, since the distance which the front incremental clamping bar will travel is quite short, the screw rods 92 can be quite short.

After the workfunction has been performed on the workpiece, the workpiece may be removed by relieving the clamping pressure on the screw rods and then lifting the workpiece out of the gap between the vise members. The rear vise member can then be moved to the rear by manually tripping the pawls 44 on both sides of the vise member 20 and moving the vise member 20 to the rear in preparation for receiving the next workpiece.

Although the degree of angularity of the front vise member need be very slight since whatever tapering is required by the shape of the workpiece can be accommodated primarily by the angleable capability of the rear vise member, it is desirable to provide some angleable capability of the front vise member so that the screw handles can be operated independently without binding. If no angleable capability were provided, the screw handles would have to be operated simultaneously, or independent operation would be restricted to only a few turns at a time. Thus, the angleable capability of the front vise member is provided primarily for the convenience of the user so that he may effect the desired clamping force be independent operation of the screw handles.

In addition, the discrete distance between the teeth of the ratchet make it desirable to provide an angleable capability for the front vise member so that the clamping pressure along the faces of the clamping members in their direction of elongation may be precisely regulated.

Figure 6:
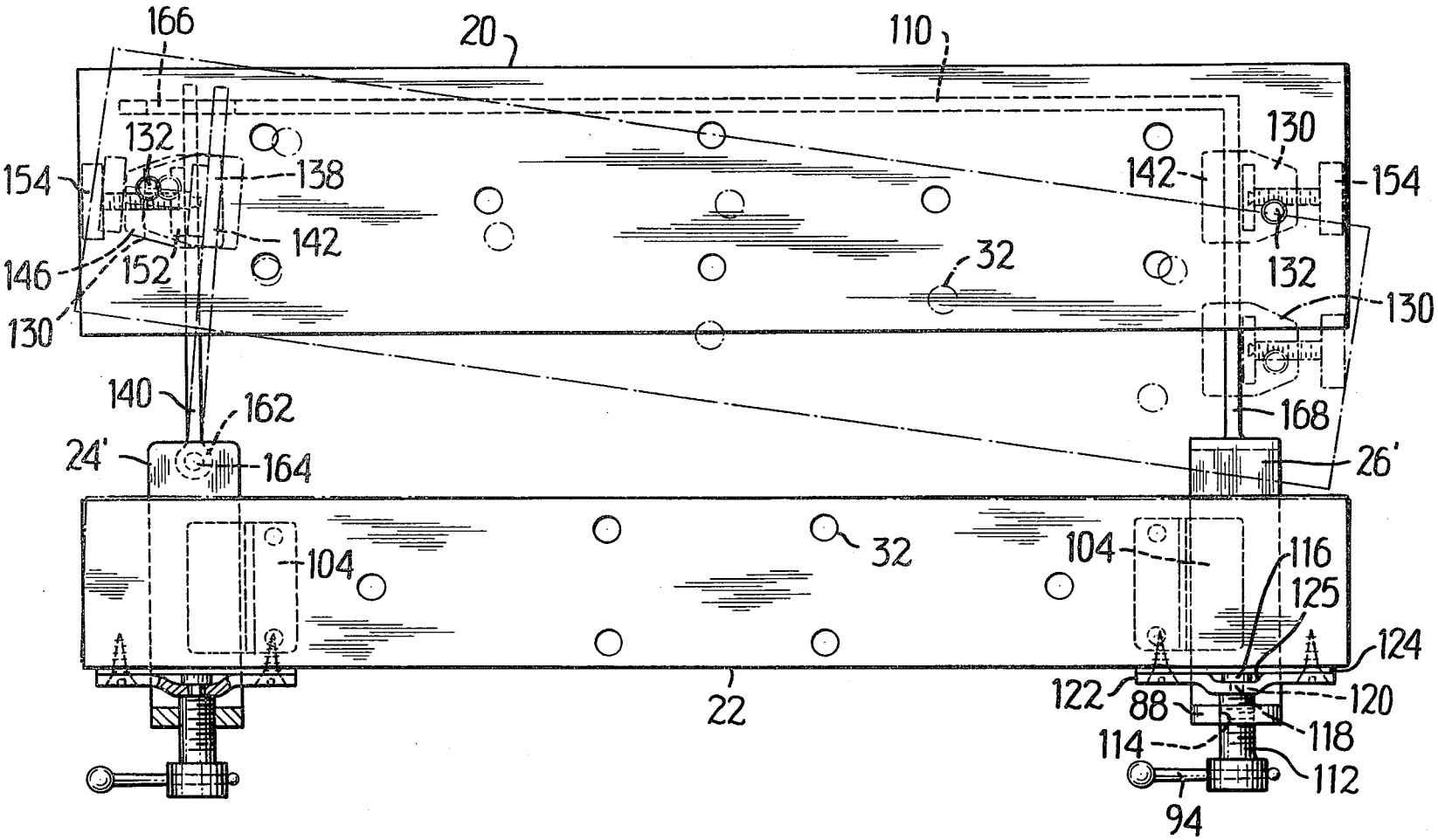
FIG. 6 is a plan view of a second embodiment of a quicksetting vise menber for a workbench according to this invention.

Looking now at FIG. 6, a second embodiment of the workbench according to this invention includes a rear elongated vise member 20 and a front elongated vise member 22. Like the embodiment illustrated in FIG. 1, the vise members of the embodiment shown in FIG. 6 may be provided with vertically extending bores in the vise members and corresponding abutment members arranged alike and for the same reason that those shown in my pending application Ser. No. 642,742 mentioned previously.

Figure 7:
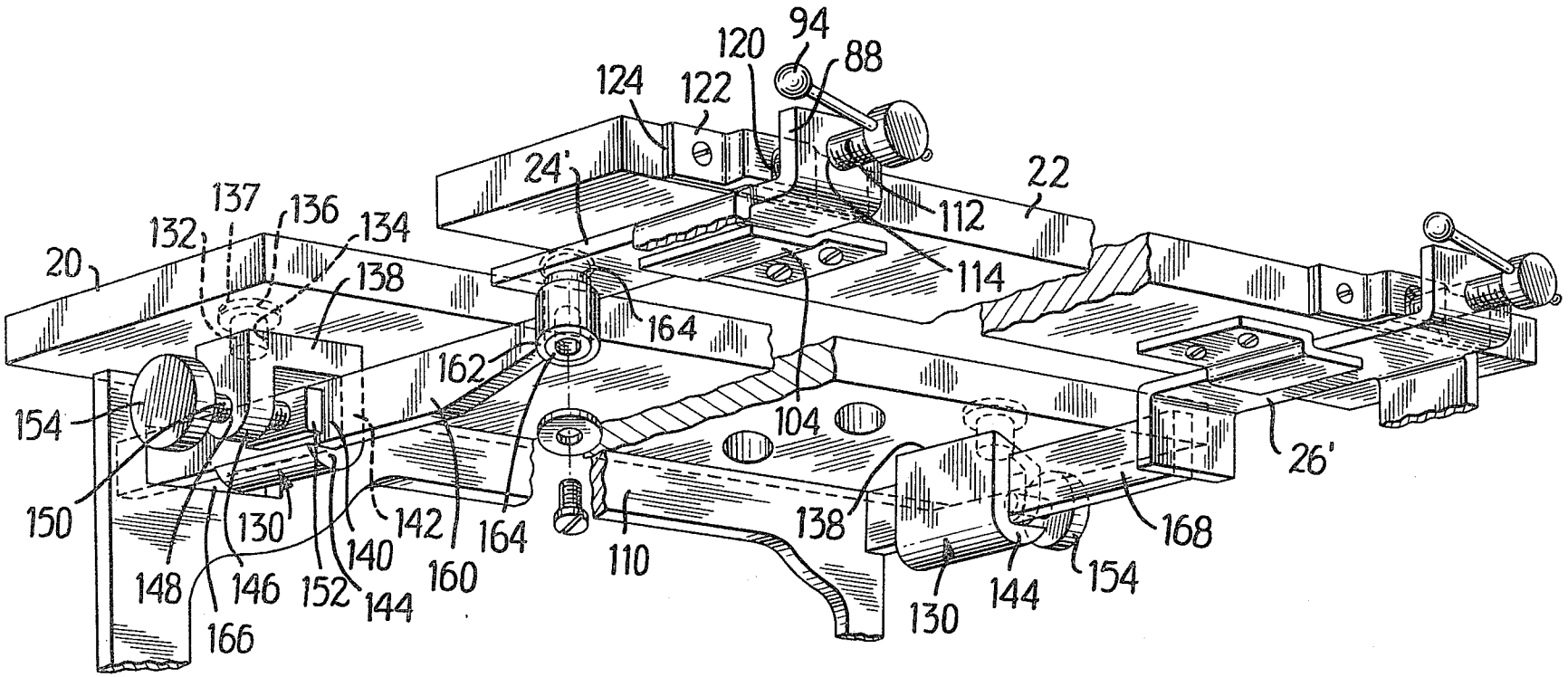
FIG. 7 is an enlarged perspective view of the underside of the vise shown in FIG. 6.

The front vise member 22 is supported by the pair of spaced support members 24' and 26', which are supported in turn by supporting structure (shown broken away for clarity of illustration in FIG. 7) connected to a main supporting framework which includes a laterally extending member 110.

The front vise member 22 is supported on the front portion of the support structure and is provided with brackets 104 similar to and for the same reason as brackets 104 in the embodiment illustrated in FIG. 1. The front vise member is therefore able to move forward and rearward and slightly angularly in the plane of the support, but its lateral freedom of movement is restricted and it is prevented from any movement out of the plane of the support.

The control of the front vise member is provided by vise operating screw rods 112 which are threaded through threaded holes 114 in the forward, vertically extending portion 88 of the support structure.

The rear end of the screw rods 112 is provided with an enlarged head 116 connected to the screw rod 112 by a reduced neck portion 118. The reduced neck portion is slightly smaller in diameter than the dimension of a vertical upwardly opening slot 120 in a plate 122 by which the front vise member is connected to the screw rod. The plate 122 is fastened over a backing plate 124 to the front of the vise member at the two ends of the plate 122 which are rearwardly offset from the center portion of the plate 122 to provide a central space 125 between the plate 122 and the backing plate 124 to receive the enlarged head 116 of the screw 112.

In operation, the screw operating handles 94 of the screw rods 112 are rotated to advance or retract the screw in the threaded hole 114 in the front portion 88 of the supporting structure. As the screw advances or retracts, it advances or retracts the front vise member 22 by virtue of the action of the enlarged head 116 of the screw 112 bearing against the backing plate 124 when the screw rod 112 is advanced, or bearing against the inner surface of the plate 122 when the screw rod is retracted.

Since the extent of travel of the front vise member 22 need be only very short, it may be unnecessary to provide a angularable capability of the front vise member 22. However, if it is desired to do so, the angularity may be provided by a loose fit of the enlarged head 116 in the central space 125 between the backing plate 124 and the plate 122. Alternatively, the enlarged head 116 may be swivelably connected to the screw 112 and the lateral dimension of the slot 120 may be made large enough to accommodate the small angular translation which occurs when the front vise 22 is operated at one end but not the other or is operated at the opposite ends in opposite directions.

The rear vise member 20 is provided with a gripping device 130 at each end thereof. The gripping device 130 is linked to the underside of the vise member 20 by a vertical pivotal connection provided by a vertical pivot pin 132. The vertical pivot pin 132 is cylindrical and fits in a vertical bore 134 of the same diameter as the vertical pivot pin 132. The vertical bore extends completely through the vise member 20 and a fastener 136 is connected to the top of the pivot pin 132 to fix the vertical position of the gripping device 130 with respect to the vise member 20. The fastening device 136 lies in a countersunk bore 137 in the top of the vise member which may then be covered by a plug to provide a continuous surface on the upper surface of the vise member 20.

The angular position of the gripping device 130 about the axis of the pivot pin 132 is freely adjustable but the angular position of the gripping device 130 with respect to any axis perpendicular to the axis of pin 132 is fixed because the pin 132 fits snuggly in the bore 134 and also because the top 138 of the gripping device 130 is firmly held flush against the underside of the vise member 20 by virtue of the fastener 136 thereby assuring that the gripping device 130 does not tilt about any axis perpendicular to the axis of pin 132.

Each gripping device 130 is provided therein with a channel 140. The channel 140 is formed by depending a flange portion 142 which has at its lower end a horizontally extending lip 144. The channel 140 is defined by a vertical face on the flange 142, an upwardly facing surface on the lip 144 and an opposed downwardly facing surface on the underside of the top 138 of the gripping device 130.

A downwardly depending lug 146 is formed on the top of the gripping device 130 opposite the depending flange 142. A horizontal hole 148 is drilled through the lug 146 and receives a fine threaded screw 150. The inner end of the screw 150 is secured to a movable gripping block 152 by a swivelable connection which enables the screw to rotate relative to the block 152 but does not move axially with respect to the block 152, so that when the screw is retracted the block 152 will also be retracted. A screw handle or thumb wheel 154 is attached to the outer end of the screw 150 to enable the screw 150 to be manually advanced and retracted in the screw hole 148.

A bar 160 having the same cross-sectional shape and dimensions as the channel 140 is positioned in the channel 140. The front end of the bar 160 is provided with a gudgeon 162 which receives a closely fitting vertical pintle 164 is fixed to the support structure 24. The connection of the bar 160 by way of the gudgeon 162 to the pintle 164 on the support structure 24 enables the bar 160 to pivot about the pintle 164 in a horizontal plane but prevents the bar 160 from pivoting about any other axis than the axis of the pintle 164. The pintle includes an axial hole which is tapped to receive a machine screw for holding a large diameter washer against the underside of the gudgeon to prevent the gudgeon from moving downwardly with respect to the pintle.

The rear end of the bar 160 extends through a horizontally elongated slot 166 formed in the transverse bar 110. The engagement of the top and bottom surfaces of the bar 160 with the top and bottom surfaces of the slot 166 assists in securing the bar 160 against rotation about an axis parallel to the transverse bar 110.

On the side of the workbench opposite to that on which the pivoted bar 160 is disposed, a bar 168 is rigidly fixed to the supporting structure 26. A gripping device 130 is disposed on the rigid bar 168 and is pinned to the other side of the rear vise member 20 in a manner identical to the manner in which the first described gripping device 130 is secured to the vise member 20.

In operation, a workpiece is placed on the supporting structure 24' and 26' between the vise members 20 and 22. The vise member 20 is then manually slid toward the vise member 22. If the workpiece is tapered, the vise member 20 can accomodate the angle of the tapered workpiece by virtue of the pivoting of the bar 160 about pintle 164.

When the front vise member 20 has been moved against the workpiece, the thumbscrews 154 on both gripping devices 130 are tightened to grip the bar 160. The gripping force of the gripping device 130 on the bar 160 and 168 is extremely large by virtue of the fact that the threads on the screw 150 are very fine and therefore the gripping devices can grip the bars 160 and 168 very securely without requiring an undue amount of torque on the thumb screws 154. In addition, the vertical surfaces of the channel 140, the block 152 and the bars 160 and 168 may be treated or textured to increase the frictional force exerted by the gripping device 130 on the bars 160 and 168.

After the rear vise member has been secured to the bars 160 and 168 the front vise member may be operated to advance the vise member 22 toward the vise member 20 thereby exerting the desired clamping force against the workpiece. The capability provided for the front vise member 22 to rotate through a horizontal angle is primarily for the convenience of the operator in enabling independent operation of the two vise operating handles 94 independently, as described previously.

Figure 8:
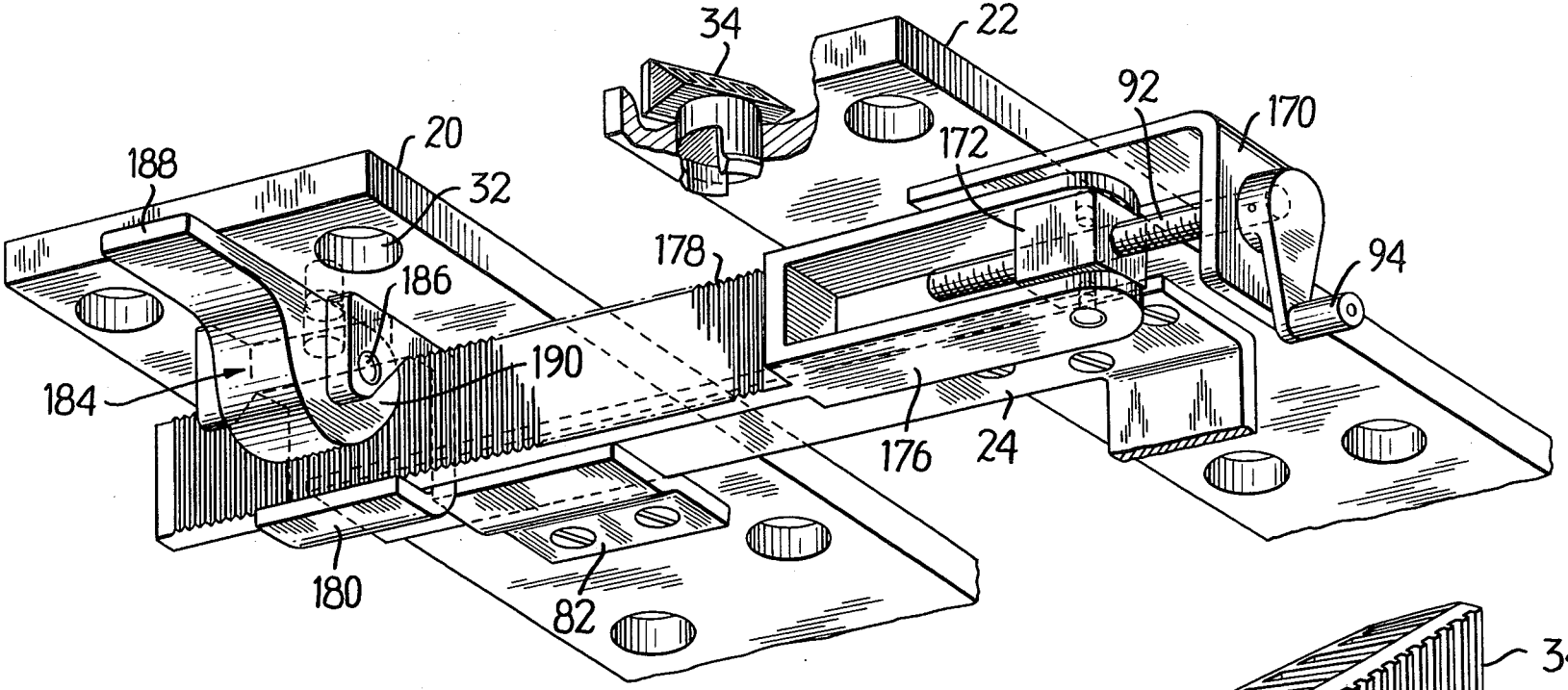
FIG. 8 is a perspective view of a third embodiment of a workbench according to the present invention.
Figure 8A:
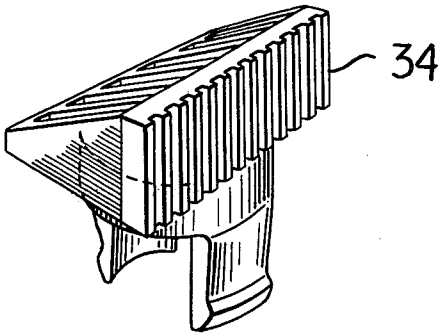
FIG. 8A is a perspective view of the plug-in abutment member shown in FIG. 8 and more fully described in my co-pending patent application Ser. No. 642,742.

Turning now to FIG. 8, a third embodiment of the invention is shown having a rear vise member 20 and a front vise member 22 disposed with respect to each other and a supporting structure in the same relationship as the configurations shown in FIGS. 1 and 6. The vise members shown in FIG. 8 also include the arrangement of holes and abutment members as described above for the embodiments of FIGS. 1 and 6.

As shown in FIG. 8, the front vise member is attached to, or has attached to it, a support bracket 170 which extends vertically in front of the vise member 22. The bracket 170 may be provided by a portion of the support members such as the member 88 shown in FIGS. 1 and 6.

A hole is formed in the bracket 170 and receives a screw threaded rod 92. The hole is of smaller diameter than the screw threaded rod. A pin extends through a hole in the rod 92 adjacent and behind the bracket 170 to secure the axial position of the rod 92 with respect to the bracket 170. Thus, the rod is axially fixed with respect to the bracket and may rotate in an axially fixed position about the axis of the rod 92.

The rod 92 extends through a threaded nut 172 which has a pair of pins projecting from the upper and lower surfaces thereof by which the nut 172 is pivotally mounted on a U-shaped bracket 176. The length of the U-shaped bracket is arranged to accommodate the maximum length of the screw threaded rod 92 which can extend through the threaded nut 172.

A bar 178 is fastened to the U-shaped bracket 176 as by welding and extends across the gap between the two vise members and underlies the rear vise member 20. The bar 178 lies in a bracket which is pinned to the underside of the rear vise member in the same manner that the gripping device 130 shown in FIG. 6 is pinned to the vise member 20. The U-shaped bracket defines a channel which receives the bar 178 in the same manner that the bar 160 shown in FIG. 6 is received by the gripping device 130.

A vertically mounted gripping device 184 is pivotally mounted on the bracket 180 by a horizontal pivot pin 186. The gripping device has an integral thumb lever 188 by which the device 184 may be rotated about the pivot pin 186. The device includes an integral gripping portion 190 which, in the usual manner of a cam, increases in radius from the pivot point around the circumference so that when the cam lever or integral thumb lever 188 is rocked about the pivot 186, the increasing radius portion 190 of the cam will be forced into contact with the vertical face of the bar 178 and thereby releasably secure the rear vise member 20 to the bar 178.

In operation, the integral thumb levers 188 on both gripping devices 184 are rotated to release the gripping pressure of the gripping portion 190 of the gripping device 184 to release the vise member 20 for free movement toward the vise member 22. A workpiece is then laid in the gap between the vise members 20 and 22 and the vise member 20 is moved in a single motion into contact with the workpiece. The vise members are thus positioned loosely in contact with opposite faces of the workpiece. The cam lever 188 on the gripping device at each end of the rise member 20 is then rotated to rotate the cam face 190 forcefully into contact with the bar 178 thereby clamping the bar 178 firmly between the cam 190 and the inside vertical face of the bracket 180. The vise member 20 is at this point firmly secured in position to the bar 178 on both ends.

The screw handles 94 are then rotated to draw the nut 172 toward the bracket 170. This causes the bracket 176 and the bar 178 to be drawn forwardly and thereby causes an incremental motion of the rear bar toward the front bar. Since the extent of travel of the rear bar necessary to effect the clamping pressure on the workpiece is only very small, the screw 92 can be quite short and the threads can be very fine, for the reasons mentioned previously.

FIGS. 9 to 12 show a further embodiment of workbench according to the invention.

As in the previous embodiments this workbench incorporates front and rear timber beams 400 and 402 respectively, each beam being of rectangular cross section and of elongate form, the two beams between them forming the complete working surface of the workbench. For this purpose each beam has a flat top surface and these surfaces are in the same horizontal plane. Each beam is provided with a plurality of vertical bores 404 to receive plug-in abutments as described in the previous embodiments.

The two beams 400 and 402 are mounted for sliding movement towards and away from one another on a pair of support rails 406 which extend transversely of the direction of elongation of the beams. Each rail 406 has a horizontal web 408 on which the beams rest, and a vertical web 410 to which a foldable supporting structure, generally indicated at 412, is connected. The manner in which the beams are mounted for relative movement can be the same as in any of the previous embodiments and therefore will not be further described, except to note that movement of the front beam 400 is controlled by a pair of crank handles 414 which are journalled in vertical front webs 416 of the rails 406.

The foldable supporting structure includes front and rear frames 418 and 420. The front frame 418 has a pair of rectangular cross-section tubular legs 422 the upper ends of which are pivoted by horizontal hinge pins 424 to the forward ends of the support rails 406. The legs 422 in the erected condition of the workbench extend downwards and forwards so that feet 426 on the lower ends of the legs are positioned well forward of the front beam 400. The front frame 418 is completed by a horizontal pressing 428 which is rigidly connected to the legs 422 and thereby strengthens the frame 418. The pressing 418 has three apertures 430 for lightness, and a horizontal ribbed flange 432 extending between the legs 422 and affording an upper step positioned slightly forwardly of the front beam 400.

Also extending between the legs 422 is a lower horizontal step 434 which incorporates a pair of side walls 436 each pivoted at 438, at its forward end, to the legs 422. The step is shown as extending rearwardly of the legs but it could, if desired have a portion extending forwardly thereof but not beyond the lower ends of the legs.

The overall height of the top surface of the beams is 30" which is a satisfactory height for carpentry. The lower step 434 is positioned 7" above the ground or 23" below the top surface of the bench so as to provide an ideal standing platform when it is desired to use the workbench as a sawhorse. The manner in which the step or platform 434 is pivoted upwards for storage will be described later.

The rear frame 420 also includes a pair of rectangular cross section legs 440 each having a small cranked plate 442 at its upper end which is journalled on the same hinge pins 424 as the front legs. The rear legs 440 are interconnected by a horizontal pressing 444 to complete the rear frame. As shown in the drawings, the rear legs extend downwardly and rearwardly and their lower ends are positioned slightly to the rear of the rear beam 402.

The side walls 436 of the lower step 434 extend rearwardly of the step, and have pivoted to them at 445 rearwardly extending links 446. The rear ends of the links 446 are pivoted at 447 to the inner side edges of the rear legs 440. The forward ends of the links 446 have small horizontal sprags 443 which maintain the links 446 and side walls 436 of the step slightly out of alignment.

Figure 12:
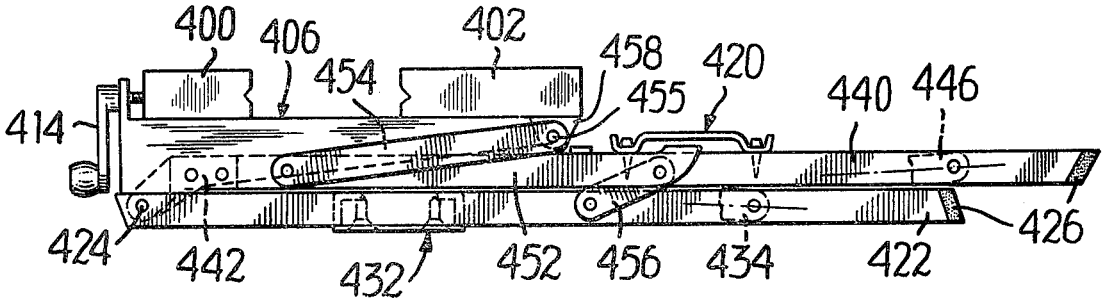
FIG. 12 is a side elevation of the workbench shown in FIG. 9 fully folded.

The folding supporting structure 412 is completed by a pair of three-part braces 450 each of which incorporates a central link 452 pivoted at 453 to one of the rear legs 440, an upper link 454 pivoted at 455 to the rear end of the support rail 406 on that side. For this purpose the rail 406 has a bracket 456 affording a vertical web 458 and the pivot 455 of the upper link 454 to the bracket is positioned at a level above the level of the hinge pin 424 at the forward end of the support rail 406 in order to allow the parts compactly to fold as shown in FIG. 12.

Each brace 450 is completed by a lower link 456 which is pivoted at 458 to the lower end of the central link 452 and at 460 to the outside surface of the associated front leg 422 at a height slightly above the lower step 434. The central link has a tongue 462 at its lower end to position the central and lower links in a slightly out of line position in the erected condition. The central link has a further tongue 464 which can be used to exert a folding force during folding of the workbench.

Figure 10:
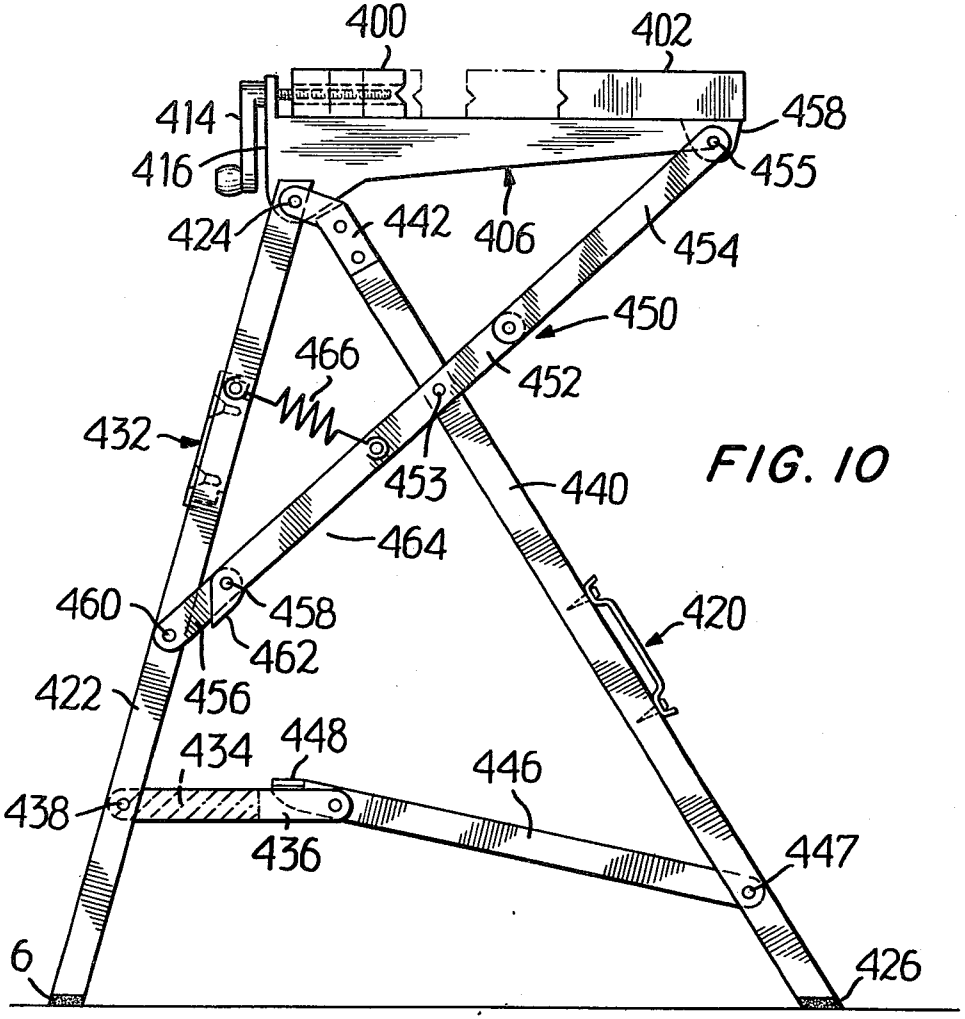
FIG. 10 is a side elevation of the workbench shown in FIG. 9.
Figure 11:
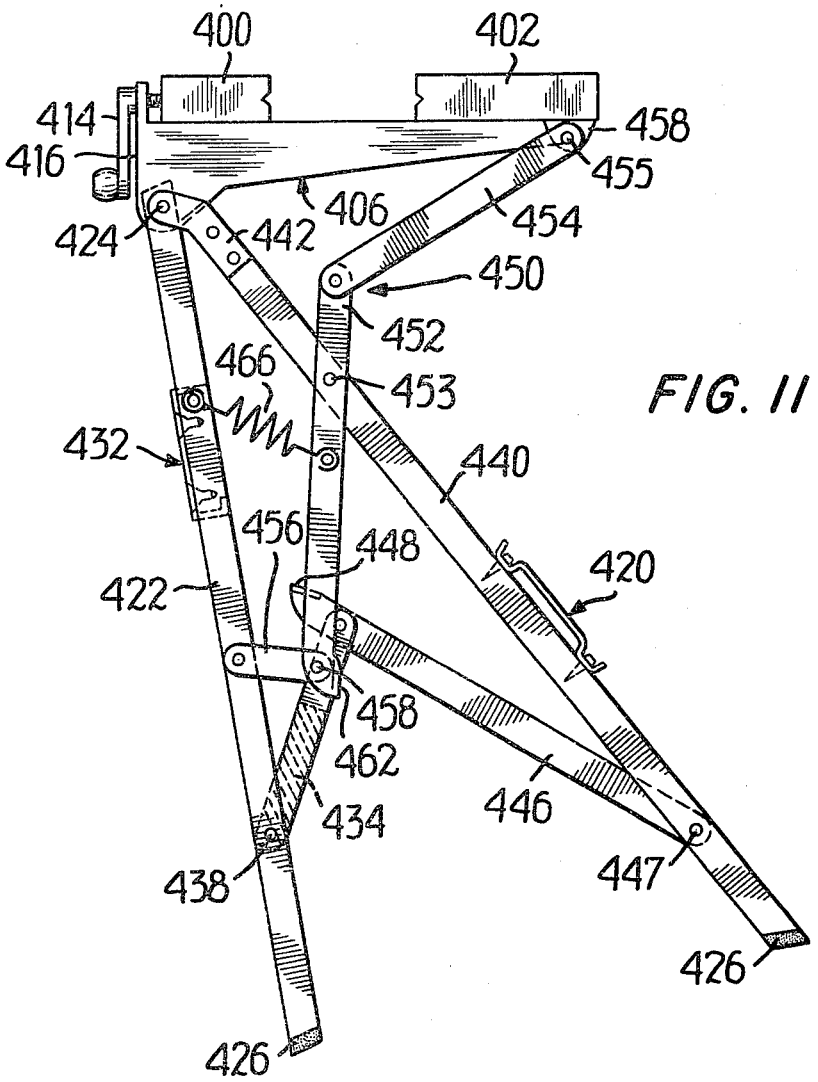
FIG. 11 is a side elevation of the workbench shown in FIG. 9 partially folded.

Illustrated in FIGS. 10 and 11 is a tension spring 466 which, in the erected condition of the workbench, maintains the brace formed by the three links 452, 454 and 456 in an aligned bracing condition.

It is to be noted that, when erected, the workbench will be extremely stable by virtue of the geometry of the legs and the brace. The rear upper end of the brace supports the rear of the workbench, downward loads on the rear beam being transmitted down the brace and into the leg structure. At each side, the support rail 406 together with the sections of the rear leg and the brace form one rigid triangle, whilst the rail 406, the whole of the brace 450 and the upper part of the front leg forms a second rigid triangle. Furthermore, the lower half of the brace, the upper section of the front leg, above the pivot 460, and the upper section of the rear leg, above the pivot 453, form a third rigid triangle.

FIG. 11 illustrates a partly folded workbench and FIG. 12 a completely folded workbench. The geometry of the legs, and the three links of the braces is such that, in the completely folded condition, the front and rear legs lie parallel to one another and as a consequence the front and rear frames are neatly nested in compact relation and in parallel relation to the top structure formed by the two beams 400 and 402 and their support rails 406.

During folding the lower step or platform 434 pivots upwards as indicated in FIG. 11, and in the completely folded condition the step 434 lies substantially between the front legs 422. In the folded condition the tension spring 466 maintains the parts in the folded state. Clearly a catch could be used as in alternative. In the erected condition of the workbench the substantially linear configuration of the lower step or platform and the links 446 form an effective strut which maintains the legs, and the braces in the erect condition, thus augmenting (or in some cases replacing the requirement of) the tension spring.

Figure 9:
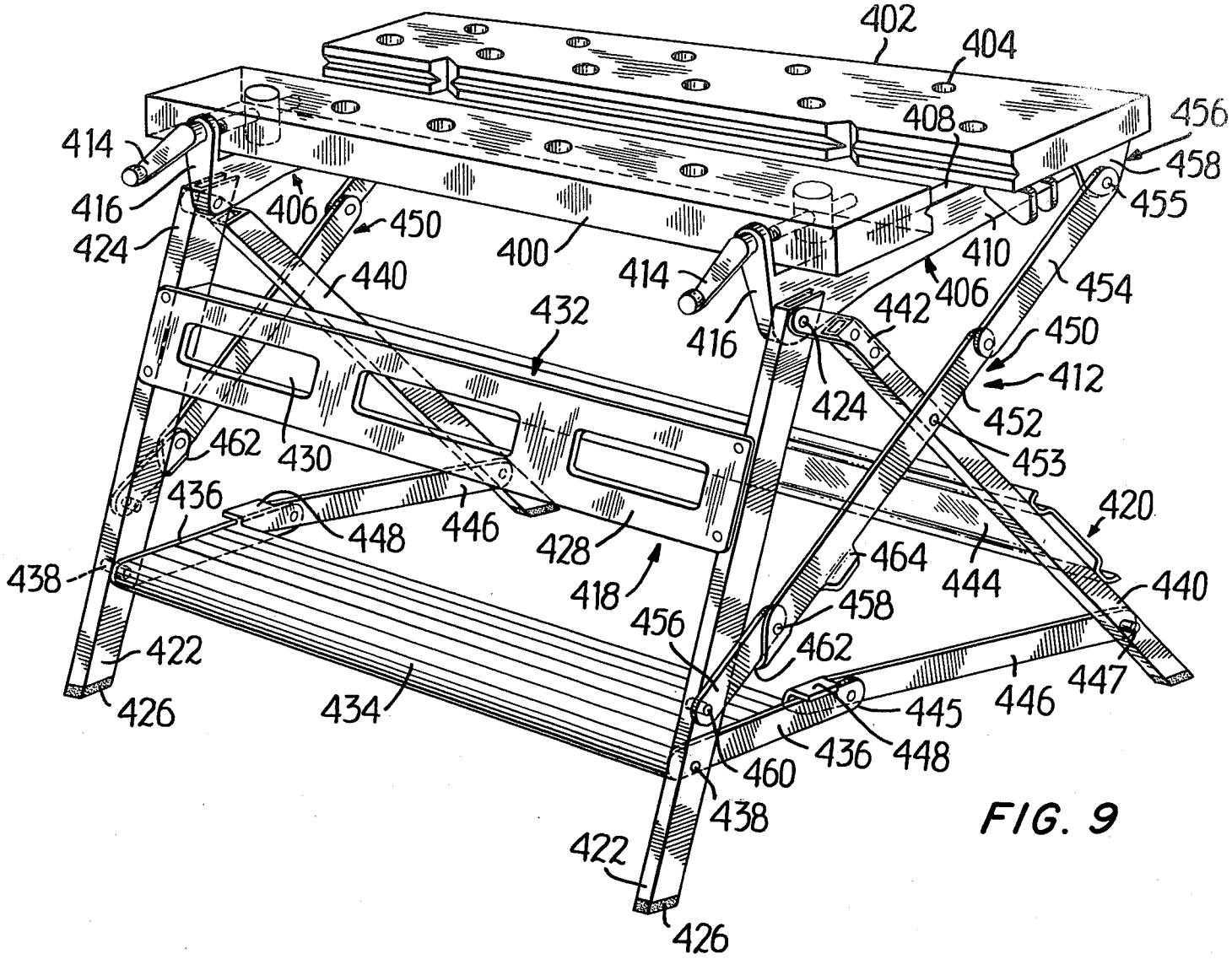
FIG. 9 is a perspective view of a workbench according to the invention showing a folding leg structure for supporting the vise structures shown in FIGS. 1, 6 and 8.

It is to be noted from FIG. 9 that the ends of the beams 400 and 402 overhang the legs and braces so as to enable a door to be clamped in the end of the vise provided by the beams.

Thus, a workbench has been disclosed which has a folding leg structure carrying a movable vise member capable of being quickly set to a position in which the vise members are loosely positioned against both faces of the workpiece whereupon an incremental clamping device may be operated to move the vise members relatively together a small incremental clamping distance to exert a relatively great force on the workpiece with very little operating effort on the clamping devices. The range of movement of the clamping members may be very great since the actual clamping force is exerted by operating devices separate from the releasable gripping device by which the vise members may be initially set adjacent the workpiece.

Although this mechanism requires one device for exerting the clamping force and an entirely separate device for releasably securing the vise members in a position closely adjacent both sides of the workpiece, the actual cost of manufacture should not be excessive because the leg structure is simple, light and of inexpensive material, and the screw rods may be quite short and narrow and the releasable gripping means can be quite inexpensive as they do not require particularly precise manufacture as do screw threads.

In addition to saving cost of manufacture, the device may be quite light. The clamping force exerting devices and the releasable gripping devices can be formed of stampings and the various bars, since they act only in tension, can be made quite thin. The structural members of the folding leg structure can be formed of strong, lightweight tubular stock material.

Obviously, numerous modifications and variations of the embodiments illustrated herein are possible and would be obvious in view of the disclosure herein and the other disclosures incorporated by reference. It is therefore expressly to be understood that the scope of the invention is to be defined only by the scope and spirit of the appended claims wherein

I claim:

1. A workbench comprising:

first and second elongate vise members;

a collapsible supporting structure, including a supporting framework having bearing surfaces defining a plane of support underlying and supporting said vise members, and a folding leg structure foldable between (1) an erected position in which the leg structure supports said vise members at a convenient working height above the floor and (2) a folded position in which the leg structure lies adjacent said vise members;

means operatively connecting said first vise member to said supporting framework for (1) rectilinear motion towards and away from said second vise member and (2) rotational motion in said plane of support relative to said second vise member;

independently releasable latching means associated with each end of said first vise member for (1) when latched, latching said associated end of said first vise member against rectilinear motion away from said second vise member and from any angular motion that carries the center of said first vise member away from said second vise member and (2), when released, permitting free rectilinear and angular motion of said associated end of said first vise member towards and away from said second vise member;

clamping means for forcefully moving said vise members relatively towards each other a short clamping stroke;

whereby a workpiece may be placed between said vise members, and said first vise member may be drawn toward said workpiece to reduce the gap between said vise members to approximately the size of the portion of said workpiece between said vise members, whereupon said clamping means may be operated to grip said workpiece forcefully between said vise members.

2. A portable workbench, comprising:

a top structure;

a base structure for carrying said top structure at a convenient working height above the floor;

said top structure including a pair of elongate vise members providing a generally rectangular, substantially flat working surface and a support structure underlying and supporting said vise members;

releasable means operatively connecting each end of one of said vise members to said support structure for (1) permitting independent rectilinear movement of said end towards the other vise member so as to permit angular movement of said one vise member relative to said other vise member and (2), when unreleased, checking the movement of said end of the one vise member away from said other vise member and, when released, permitting movement of said end away from said other vise member;

clamping means connected to said other vise member for forcefully moving said vise members relatively together a short incremental clamping distance to forcefully grip a workpiece between said vise members after said one vise member has been freely moved to loosely secure said workpiece between said vise members.

3. A workbench comprising:

front and rear, laterally elongated vise members, each having a vertically extending gripping face and a substantially flat generally rectangular upper surface, both the front-to-rear dimension and the lateral dimension of each upper surface being substantially greater than the vertical depth of said gripping face so as to provide a working surface of substantial horizontal extent;

a supporting structure having upwardly facing bearing surfaces for supporting said vise members for generally front-to-rear movement along said surfaces;

means for linking one of said vise members to said supporting structure for movement in the plane of said bearing surfaces towards and away from the other vise member and also for rotational movement in the plane of said bearing surfaces with respect to said other vise member, said linking means also preventing substantial movement of said one vise member away from said bearing surfaces, said linking means including releasable grip means for permitting free rectilinear movement of each lateral end of said one vise member towards the other vise member independently of the other end of said one vise member, whereby said one vise member may be angularly disposed relative to said other vise member, said releasable grip means preventing, unless released, all rectilinear movement of said each end of one vise member away from said other vise member;

vise operating means connected between said other vise member and said support structure for moving said other vise member towards said one vise member and exerting a clamping force against a workpiece positioned between the gripping faces of said vise members;

whereby a workpiece may be placed between the gripping surfaces of said vise members and said one vise member may be moved to loosely hold the workpiece between the gripping faces of said vise members and said vise operating means may then be operated to move said other vise member forcefully towards said one vise member to firmly grip said workpiece between said gripping faces while said releasable grip means prevents said one vise member from moving away from said other vise member.

4. A workbench, comprising:

a first vise member;

a second vise member;

a supporting structure lying beneath and supporting both of said vise members;

a folding leg structure for supporting said supporting structure;

linking means for linking said vise members to said supporting structure and for permitting free rectilinear movement of said first vise member towards said second vise member, and free rotational movement of each end of said first vise member, independently of the other end thereof, towards said second vise member, said rectilinear and rotational movements being confined to said plane of support while preventing all substantial movement out of said plane of support;

a pair of spaced releasable grip means for independently releasably securing each end of said first vise member against movement with respect to said supporting structure away from the other vise member;

means for independently operating each end of said other vise members an distance toward the first vise member to exert a clamping force on a workpiece positioned between said vise member.

5. A workbench as defined in claim 4 wherein:

said folding leg structure includes a front pair of legs having upper ends which are pivotally connected to said supporting framework adjacent its front end, and lower ends which are arranged to engage the floor at regions disposed forwardly of said vise members; and a rear pair of legs having upper ends which are pivotally connected to said supporting framework and lower ends which are arranged to engage the floor rearwardly of the lower ends of the front pair of legs;

said collapsible supporting structure further includes a pair of folding brace means, one at each end of the workbench, pivotally connected to the top structure and to one of said pairs of legs; and a horizontally extending step extending between the legs of the front pair and having at least part thereof positioned forwardly of a plan projection of the vise members to form a platform enabling the user to stand thereon in front of said vise members.

6. A workbench as defined in claim 1, wherein said releasable means is movable in a direction having a component parallel to the direction of elongation of said first vise member relative to one of said supporting structure and said first vise member when said first vise member is rotating in said plane of support.

7. A workbench, comprising:

(a) a top structure incorporating a vise, said vise including a pair of elongated vise members, each having a horizontally elongated vertical clamping face and having upper surfaces lying in substantially the same plane to form a working surface, said vise members being disposed side-by-side with said clamping faces in opposed relationship;

(b) a supporting structure underlying and supporting said vise members and including:

(i) a front pair of legs having upper ends which are pivotally connected to the top structure, and lower ends which are arranged to engage the floor at regions disposed forwardly of the front of said top structure, (ii) a rear pair of legs having upper ends pivotally connected to said top structure, and lower ends which are arranged to engage the floor rearwardly of the lower end of the front pair of legs;

(iii) folding brace means at each end of the workbench, each brace means including a top link pivotally connected at one end to the top structure adjacent the rear edge thereof, a lower link pivotally connected at one end to said front leg, and a central link pivotally connected to said rear leg and to the other ends of said top link and said lower link;

(iv) a horizontally extending step extending between the legs of the front pair and having at least part thereof positioned forwardly of a plan projection of said top structure to form a platform enabling the user to stand thereon in front of the top structure with the top structure at sawhorse height, said step being pivoted to the legs of the front pair for folding between a horizontal platform-forming position and a storage position in which the step lies substantially parallel to the legs of the front pair; and (v) strut means having forward regions pivotally connected to the rear of said step and rearward regions pivotally connected to the supporting structure rearwardly of the rear of said step, said front and rear pairs of legs together with the folding brace means and the step and strut means being foldable simultaneously between an erected condition in which the brace means brace the legs apart and rigidly support the top structure, and the folded position which the top structure, the front and rear pairs of legs, the brace means, the step and strut means lie in compact proximity.

8. A workbench comprising:

first and second elongate vise members;

a collapsible supporting structure, including a supporting framework having bearing surfaces defining a plane of support underlying and supporting said vise members, and a folding leg structure foldable between (1) an erected position in which the leg structure supports said vise members at a convenient working height above the floor and (2) a folded position in which the leg structure lies adjacent said vise members;

means operatively connecting said first vise member to said supporting framework for (1) rectilinear motion towards and away from said second vise member and (2) rotational motion in said plane of support relative to said second vise member;

releasable latching means, including a notched rack on said supporting structure adjacent each end of said first vise member and a pawl connected to each end of said first vise member for engagement with said notched rack, for (1) releasable latching said first vise member against rectilinear motion away from said second vise member and from any angular motion that carries the center of said first vise member away from said second vise member and (2) when released, permitting free rectilinear and angular motion of said first vise member towards and away from said second vise member;

clamping means for forcefully moving said vise members relatively towards each other a short clamping stroke;

whereby a workpiece may be placed between said vise members and said first vise member may be drawn towards said workpiece to reduce the gap between said vise members to approximately the size of the portion of said workpiece between said vise members, whereupon said clampig means may be operated to grip said workpiece forcefully between said vise members.

9. A workbench as defined in claim 8, wherein at least one of said pawls is connected to said first vise member by a movable connection that enables said pawl to move relative to said first vise member in a direction parallel with the direction of elongation of said first vise member when said first vise member moves angularly in a said plane of support, whereby said pawl will remain in engagement with said notched rack.

10. A workbench comprising:

first and second elongate vise members;

a collapsible supporting structure, including a supporting framework having bearing surfaces defining a plane of support underlying and supporting said vise members, and a folding leg structure foldable between (1) an erected position in which the leg structure supports said vise members at a convenient working height above the floor, and (2) a folded position in which the leg structure lies adjacent said vise members;

means operatively connecting said first vise member to said supporting framework for (1) rectilinear motion towards and away from said second vise member and (2) rotational motion in said plane of support relative to said second vise member;

releasable latching means, including a pawl at each end of said one vise member, at least one of which pawls is movably connected to said one vise member for translation relative thereto when said one vise member rotates in said plane of support, said releasable means also including a row of ratchet teeth on said support structure at each end of said one vise member for engagement with said pawls, said one pawl moving rectilinearly along said row of ratchet teeth as said one vise member rotates in said plane of support, for (1) releasably latching said first vise member against rectilinear motion away from said second vise member and from any angular motion that carries the center of said first vise member away from said second vise member and (2), when released, permitting free rectilinear and angular motion of said first vise member towards and away from said second vise member;

clamping means for forcefully moving said vise members relatively towards each other through a short clamping stroke;

whereby a workpiece may be placed between said vise members, and said first vise member may be drawn towards said workpiece to reduce the gap between said vise members to approximately the size of the portion of said workpiece between said vise members, whereupon said clamping means may be operated to grip said workpiece forcefully between said vise members.

11. A workbench comprising:

first and second elongate vise members;

a collapsible supporting structure, including a supporting framework having bearing surfaces defining a plane of supporting underlying and supporting said vise members, and a folding leg structure foldable between (1) an erected position in which the leg structure supports said vise members at a convenient working height above the floor, and (2) a folded position in which the leg structure lies adjacent said vise members;

means operatively connecting said first vise member to said supporting framework for (1) rectilinear motion towards and away from said second vise member and (2) rotational motion in said plane of support relative to said second vise member;

releasable latching means, including (a) two gripping devices, one of which is connected to each end of said one vise member and at least one of which is movable relative to one of said supporting structure and said one vise member, and (b) two bars, one at each end of said one vise member, connected to said supporting structure and releasably gripped by the associated gripping device, for (1) releasably latching said first member against rectilinear motion away from said second vise member and from any angular motion that carries the center of said first vise member away from said second vise member and (2), when released, permitting free rectilinear and angular motion of said first vise member towards and away from said second vise member;

clamping means for forcefully moving said vise members relatively towards each other through a short clamping stroke;

whereby a workpiece may be placed between said vise members, and said first vise member may be drawn towards said workpiece to reduce the gap between said vise members to approximately the size of the portion of said workpiece between said vise members, whereupon said clamping means may be operated to grip said workpiece forcefully between said vise members.

12. A workbench as defined in claim 11, wherein said gripping devices are both pivotally connected to said one vise member and one of said bars is movably connected to said supporting structure to move in a direction having a component in the direction of elongation of said one vise member when said one vise member rotates in said plane of support.

13. A workbench as defined in claim 12 wherein said one bar is pivotally mounted on said supporting structure and swings through a horizontal arc when said one vise member rotates in said plane of support.

14. A workbench as defined in claim 13, wherein said clamping means comprises two screw rods, one each adjacent each end of said one vise member, and two internally threaded couplings, one threadedly engage with each of said rods and pivotally connected to said bars.

15. A workbench comprising:

first and second elongate vise members;

a collapsible supporting structure, including a supporting framework having bearing surfaces defining a plane of support underlying and supporting said vise members, and a folding leg structure foldable between (1) an erected position in which the leg structure supports said vise members at a convenient working height above the floor and (2) a folded position in which the leg structure lies adjacent said vise members;

means operatively connecting said first vise member to said supporting framework for (1) rectilinear motion towards and away from said second vise member and (2) rotational motion in said plane of support relative to said second vise member;

releasable latching means for (1) releasable latching said first vise member against rectilinear motion away from said second vise member and from any angular motion that carries the center of said first vise member away from said second vise member and (2) when released, permitting free rectilinear and angular motion of said first vise member towards and away from said second vise member;

clamping means for forcefully moving said vise members relatively toward each other a short clamping stroke, said clamping means cmprising (1) two screw rods, one adjacent each end of said second vise member, and (2) two couplings, one engaged with each of said rods, said couplings pivotally connecting said screw rods to said second vise member;

whereby a workpiece may be placed between said vise members and said first vise member may be drawn towards said workpiece to reduce the gap between said vise members to approximately the size of the portion of said workpiece between said vise members, whereupon said clamping means may be operated to grip said workpiece forcefully between said vise members.

16. A workbench as defined in claim 15, wherein said couplings each include an internally threaded member threadedly engaged with one of said screw rods and pivotally linked to said second vise member.

17. A workbench comprising:

front and rear elongate vise members;

a collapsible supporting structure, including a supporting framework having bearing surfaces defining a plane of support underlying and supporting said vise members, and a folding leg structure foldable between (1) an erected position in which the leg structure supports said vise members at a convenient working height above the floor and (2) a folded position in which the leg structure lies adjacent said vise members;

said folding leg structure including (1) a front pair of legs having upper ends which are pivotally connected to said supporting framework adjacent the front thereof and lower ends which are arranged to engage the floor at regions disposed forwardly of said vise members and (2) a rear pair of legs having upper ends which are pivotally connected to said supporting framework and lower ends which are arranged to engage the floor rearwardly of the lower ends of the front pair of legs;

said collapsible supporting structure further including (1) folding brace means at each end of the workbench pivotally connected to the supporting framework and to said pairs of legs and (2) a laterally extending step extending between the legs of the front pair of legs and having, when said leg structure is erected, at least part thereof positioned forwardly of a plan projection of the vise members to form a platform enabling the user to stand thereon in front of said vise members;

means operatively connecting said first vise member to said supporting framework for (1) rectilinear motion towards and away from said second vise member and (2) rotational motion in said plane of support relative to said second vise member;

releasable latching means for (1) releasable latching said first vise member against rectilinear motion away from said second vise member and from any angular motion that carries the center of said first vise member away from said second vise member and (2) when released, permitting free rectilinear and angular motion of said first vise member towards and away from said second vise member;

clamping means for forcefully moving said vise members relatively towards each other through a short clamping stroke;

whereby a workpiece may be placed between said vise members and said first vise member may be drawn towards said workpiece to reduce the gap between said vise members to approximately the size of the portion of said workpiece between said vise members, whereupon said clamping means may be operated to grip said workpiece forcefully between said vise members.

18. A workbench top structure comprising:

a first vise member;

a second vise member;

a supporting structure lying beneath and supporting both of said vise members;

linking means for linking said vise members to said supporting structure and for permitting free rectilinear movement of said first vise member towards said second vise member, and free rotational movement of each end of said first vise member, independently of the other end thereof, towards said second vise member, said rectilinear and rotational movements being confined to said plane of support while preventing all substantial movement out of said plane of support;

a pair of spaced releasable grip for independently releasably securing each end of said first vise member against movement with respect to said supporting structure away from the other vise member;

means for independently operating each end of said other vise members a distance toward the first vise member to exert a clamping force on a workpiece positioned between said vise member.

19. A portable workbench, comprising:

first and second elongated top members, the upper surfaces of which are substantially coplanar and together provide a working surface and elongated edges of which are disposed in side-by-side facing relation;

a supporting structure lying beneath and supporting both of said top members;

a leg structure for supporting said working surface at a convenient working height over a floor;

means for linking said top members to said suporting structure and for permitting (1) free rectilinear movement of said first top member towards said second top member and (2) free rotational movement of each end of said first top member, independently of the other end thereof, towards said second top member, said linking means further restraining said top members against substantially any movement out of said plane of support, whereby said first top member may be angularly disposed in said plane of support relatively to said second top member;

a pair of spaced releasable grip means for independently releasably securing each end of said first top member against movement with respect to said supporting structure away from the other top member; and means carried by said top members for enabling a workpiece to be securely clamped on said top members.

20. The workbench of claim 19 wherein said workpiece clamping means includes (1) a plurality of bores provided in the upper surface of each top member and (2) abutment members, each having a workpiece engaging surface thereon, at least one abutment member being received in a bore of each top member whereby a workpiece may be clamped between the abutment members carried by the first and second top members.

21. The workbench of claim 19 wherein said workpiece clamping means includes vertical clamping surfaces on the facing edges of said first and second top members and vise operating means for moving said first and second top members relative to one another through a short clamping stroke to grip a workpiece between said clamping surfaces.

22. A portable workbench comprising:

(a) a top structure, including front and rear, laterally elongated top members, the upper surfaces of which are substantially coplanar and together form the working surface of the workbench and laterally elongated edges of which are disposed in side-by-side facing relation to provide a gap between said top members extending over th full lateral extent of said members;

(b) a supporting structure underlying and supporting said top structure and including:

(i) a front pair of legs having upper ends which are pivotally connected to the top structure and lower ends which, in the erected condition of the workbench, engage the floor at regions disposed forwardly of the front of said top structure and support said working surface at full workbench height over the floor;

(ii) a rear pair of legs having upper ends pivotally connected to said top structure and lower ends which, in said erected condition, engage the floor rearwardly of said top structure and support said working surface at full workbench height over the floor;

(iii) foldable brace means interconnecting said front legs and said rear legs at each end of said supporting structure for folding between (1) a use position corresponding to the erected condition of the workbench, in which said each brace means rigidly braces said front and rear legs in front-to-rear downwardly-diverging relation to support said working surface at full workbench height over the floor, and (2) a storage position, in which said each brace means, said front leg means, and said rear leg means extend generally parallel to said working surface to form a compact storage configuration;

(iv) step means extending laterally between and pivoted to said front pair of legs for folding relative thereto between (1) a use position corresponding to the erected condition of the workbench, in which said step means defines a horizontal foot surface located at sawhorse height below said working surface, and (2) a storage position, corresponding to said storage position of the workbench, in which said step means lies substantially parallel to said front pair of legs; and, (v) linkage means coupled to said rear leg means for pivoting said step means between said use position and said storage position upon movement of said brace means between said erected condition and said storage condition, respectively.

* * * * *

UNITED STATES PATENT OFFICE

CERTIFICATE OF CORRECTION

Patent No. 4,127,260 Dated November 28, 1978

Inventor(s) Ronald P. Hickman

It is certified that error appears in the above-identified patent and that said Letters Patent are hereby corrected as shown below:

Column 1, line 29, "vice" should read --vise--;
Column 3, line 13, "Fig. 5a" should read --Fig. 5A--;
Column 4, line 31, "of" should read --or--;
Column 6, line 25, "be" should read --by--;
Column 8, line 9, after "164" insert --which--;
Column 8, line 9, "24" should read --24'--;
Column 8, line 11, "24" should read --24'--;
Column 8, line 27, "26" should read --26'--;
Column 9, line 56, "rise" should read --vise--;
Column 10, line 39, "418" should read --428--;
Column 14, line 38, "an distance" should read --a distance--;
Column 14, line 40, "member" should read --members--;
Column 15, line 47, before "which" insert --in--;
Column 16, line 3, "releasable" should read --releasably--;
Column 16, line 19, "clampig" should read --clamping--;
Column 16, line 27, delete "a";
Column 17, line 32, after "first" insert --vise--;
Column 17, line 65, "engage" should read --engaged--;

CERTIFICATE OF CORRECTION

Patent No. 4,127,260 Dated November 28, 1978

Inventor(s) Ronald P. Hickman

It is certified that error appears in the above-identified patent and that said Letters Patent are hereby corrected as shown below:

Column 18, line 15, "releasable" should read --releasably--;
Column 18, line 25, "cmprising" should read --comprising--;
Column 19, line 11, "releasable" should read --releasably--;
Column 19, line 45, after "grip" insert --means--;
Column 19, line 63, "suporting" should read --supporting--;
Column 20, line 37, "th" should read --the--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*